US006633011B2

(12) United States Patent
Ogawa et al.

(10) Patent No.: US 6,633,011 B2
(45) Date of Patent: Oct. 14, 2003

(54) SWITCH BUTTON AND METHOD OF MANUFACTURING SWITCH BUTTON

(75) Inventors: Satoshi Ogawa, Aichi (JP); Yoshiyuki Aoki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/858,933

(22) Filed: May 16, 2001

(65) Prior Publication Data

US 2001/0047927 A1 Dec. 6, 2001

(30) Foreign Application Priority Data

May 31, 2000 (JP) ..... 2000-161704

(51) Int. Cl.[7] ..... H01H 3/12
(52) U.S. Cl. ..... 200/343
(58) Field of Search ..... 200/343, 344, 200/345, 339; 400/490–6

(56) References Cited

U.S. PATENT DOCUMENTS 3,952,175 A 4/1976 Golbeck et al.
4,855,548 A * 8/1989 Curley et al. ..... 200/345
5,003,140 A * 3/1991 Abell, Jr. et al. ..... 200/344
5,422,447 A * 6/1995 Spence ..... 200/343 X
5,481,074 A * 1/1996 English ..... 200/343 X
5,717,429 A * 2/1998 Coulon et al. ..... 200/344 X
5,951,349 A 9/1999 Larose et al.
5,990,432 A * 11/1999 Kuroda ..... 200/343
6,005,209 A * 12/1999 Burleson et al. ..... 200/343
6,023,033 A * 2/2000 Yagi et al. ..... 200/512

FOREIGN PATENT DOCUMENTS

GB 2087154 * 5/1982 ..... 200/339
JP 4-315715 * 11/1992
WO WO 99/10905 3/1999

* cited by examiner

*Primary Examiner*—Renee Luebke
(74) *Attorney, Agent, or Firm*—Crompton, Seager & Tufte, LLC

(57) ABSTRACT

A switch button is coupled to a supporting member through a hinge. The switch button and the hinge are integrally molded using a synthetic resin or an elastomer, or a synthetic resin and a synthetic rubber, respectively. In this way, the switch button can be readily pressed and comfortably manipulated.

5 Claims, 4 Drawing Sheets

SWITCH BUTTON AND METHOD OF MANUFACTURING SWITCH BUTTON

BACKGROUND OF THE INVENTION

The present invention relates to a switch button for use in car audio equipment, air conditioners for vehicles, and so on. More particularly, the present invention relates to a switch button coupled to a supporting member through a hinge, and a method of manufacturing the switch button.

A conventional switch button 51 illustrated in FIG. 7 is supported in a cantilevered state by a supporting member 53 fixed to a case 52 through a hinge 54. The switch button 51, hinge 54 and supporting member 53 are integrally molded using, for example, hard synthetic resins such as ABS resin. The hinge 54 includes a curved portion 54*a* which is formed in an arc shape.

When the switch button 51 is pressed from a direction indicated by an arrow in FIG. 7, the curved portion 54*a* of the hinge 54 is deflected, so that the hinge 54 is bent toward the supporting member 53. This causes the switch button 51 to move from a position indicated by the broken lines to the position indicated by solid lines in FIG. 7. With this movement, a switch, not shown, arranged behind the switch button 51 (on the right-hand side in FIG. 7) is turned on or off.

Also, in another conventional structure illustrated in FIG. 8, a switch button 51 is integrally molded, for example, with a hinge 54 and a supporting member 53. The hinge 54 is formed of a hard synthetic resin such as ABS resin. The switch button 51 is attached for pivotal movement about the axis of the hinge 54. When one end of the switch button 51 is pressed from above, the hinge 54 is twisted in a direction indicated by an arrow in the figure. This causes the switch button 51 to pivot about the axis of the hinge 54 to turn a switch, not shown, on or off.

The hinges 54 illustrated in FIGS. 7 and 8 are formed of a hard synthetic resin. The switch buttons 51 are pressed against the resilient forces of the hinges 54. Therefore, a large pressing force is required for manipulating the switch button 51, thus poor switch operating response.

Also, in FIG. 7, when the switch button 51 is pressed, the switch button 51 pivots about the curved portion 54*a* of the hinge 54, which acts as a fulcrum. Thus, the direction in which the switch button 51 is pressed is different from the direction in which the switch button 51 actually moves. For this reason, the switch button 51 has a poor operating response.

BRIEF SUMMARY OF THE INVENTION

It is an object of the present invention to provide a switch button that is capable of allowing the user to readily press and comfortably manipulate the button, and a method of manufacturing the switch button.

To achieve the above object, the present invention provides a switch button coupled to a supporting member through a hinge. The switch button and the hinge are integrally molded using a synthetic resin and an elastomer, respectively, or a synthetic resin and a synthetic rubber, respectively.

The present invention also provides a method of manufacturing a switch button. The method comprises injecting a synthetic resin into a first cavity of a mold to mold a switch button, injecting one of elastomer and synthetic rubber into a second-cavity of the mold to form a supporting member, and injecting the elastomer or synthetic rubber into a third cavity in communication with the second cavity to mold a hinge. The hinge is integrally molded with the switch button.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which:

FIG. 4(*b*) is a side view illustrating the switch button in FIG. 1 after it is pressed;

FIG. 5(*b*) is a cross-sectional view showing the state of the mold after the switch button is molded;

DETAILED DESCRIPTION OF THE PREFERRED EMBODIMENTS

In the following, a first embodiment of the invention will be described with reference to FIGS. 1 to 5(*a*), 5(*b*).

Figure 1:
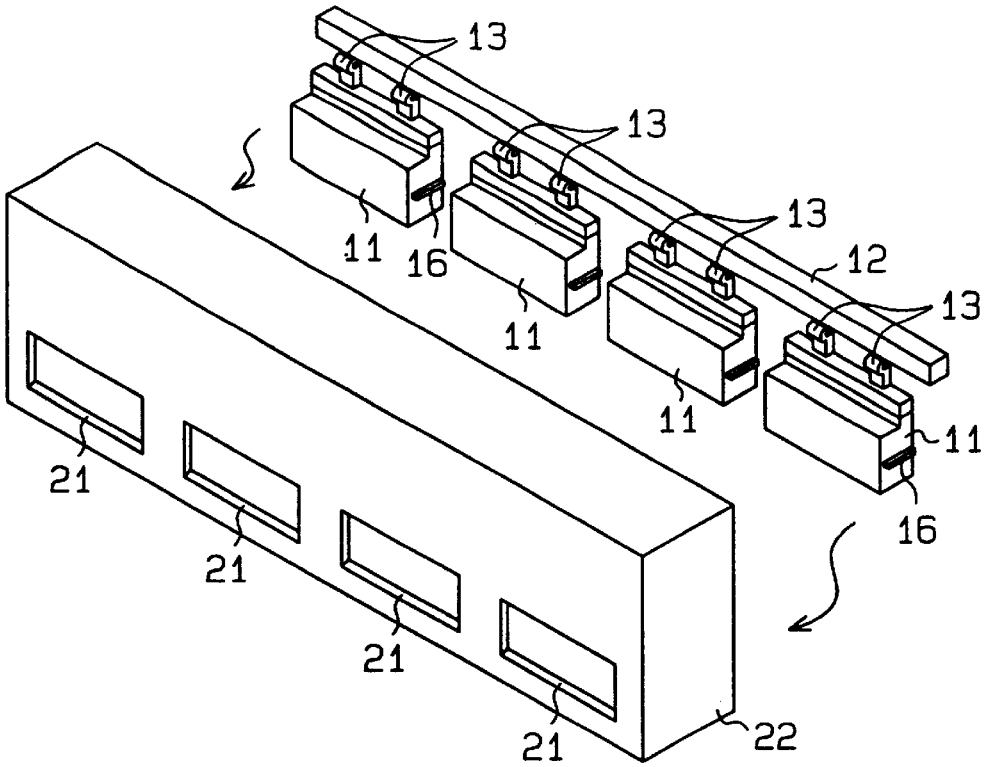
FIG. 1 is a perspective view illustrating a switch button and a case in a first embodiment in which the present invention is embodied.
Figure 3:
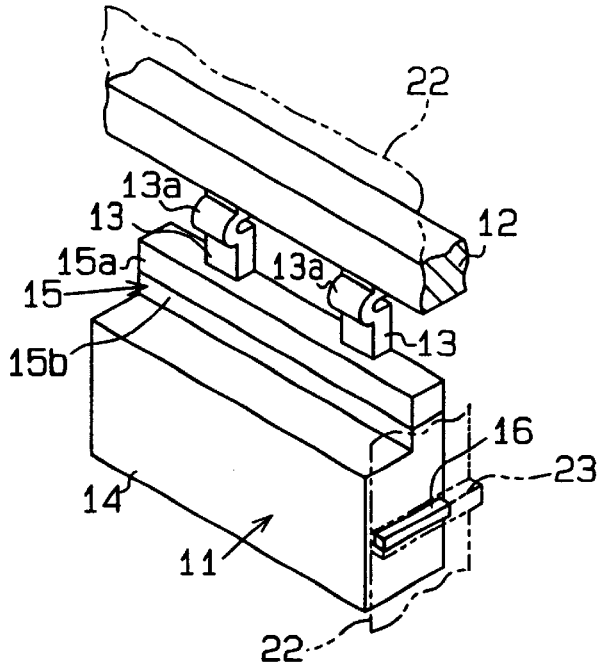
FIG. 3 is a perspective view of the switch button in FIG. 1.
Figure 4A:
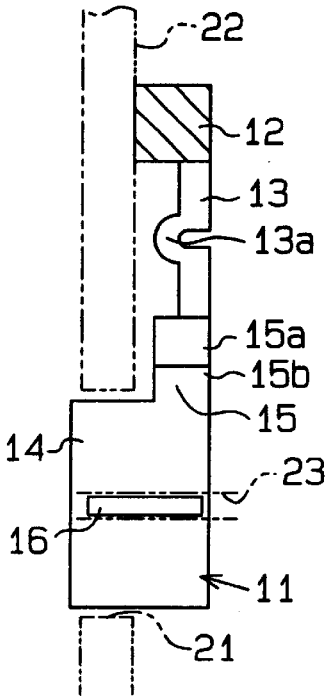
FIG. 4(*a*) is a side view illustrating the switch button in FIG. 1 before it is pressed.
Figure 4B:
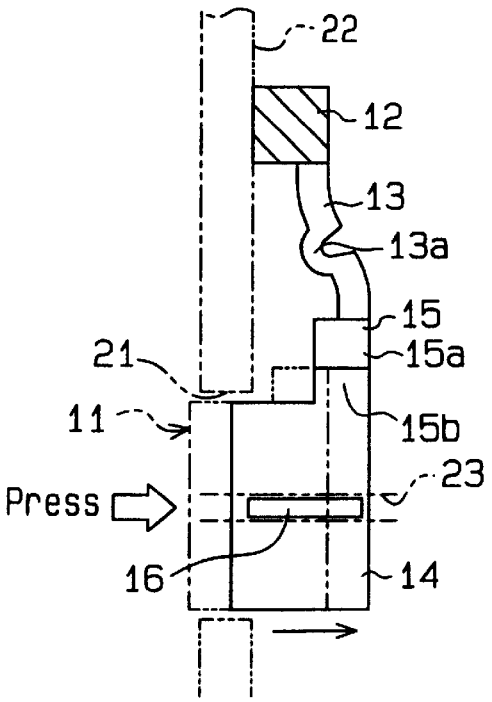

As illustrated in FIG. 1, a plurality (four in this embodiment) of switch buttons 11 are attached to a supporting member 12 at predetermined intervals. Each switch button 51 is coupled to the supporting member 12 through a pair of hinges 13 in a cantilevered state. As illustrated in FIGS. 3 and 4(*a*), each hinge 13 has a curved portion 13*a*. The supporting member 12 and each hinge 13 are integrally molded using an elastomer. The elastomer is a polymer material having elasticity at ordinary temperature such as rubber or the like.

Each switch button 11 comprises a pressing portion 14, and a coupler 15, which is thinner than the pressing portion 14. Each coupler 15 is located between the pressing portion 14 and the supporting member 12. Each pressing portion is formed of ABS resin. Each coupler 15 has a first coupling portion 15*a*, which is formed of an elastomer, and a second coupling portion 15*b*, which is formed of ABS resin. The coupler 15 is thicker than the hinge 13. The first coupling portion 15*a* is integrally formed with the hinges 13. The second coupling portion 15*b* is integrally formed with the switch button 11. The opposite sides of each pressing portion 14 have integral guide ribs 16, respectively.

The four switch buttons 11 are mounted in a case 22, which has a plurality (four in this embodiment) of openings 21, as illustrated in FIG. 1. As illustrated in FIG. 4(*a*), the supporting member 12 is fixed on the inner wall of the case 22. The pressing portion 14 of each switch button 11 is fitted in the corresponding opening 21.

Figure 2:
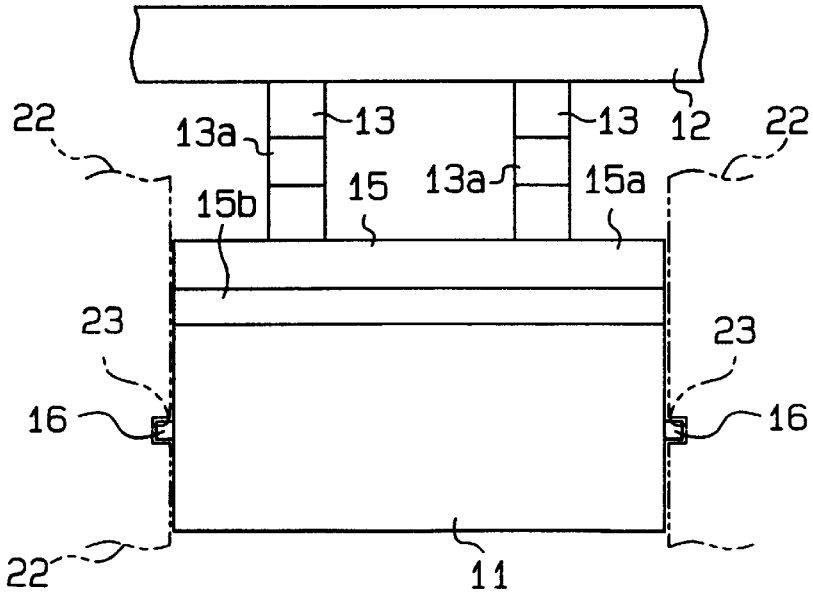
FIG. 2 is a front view of the switch button in FIG. 1.

As illustrated in FIGS. 2 through 4(*a*), (*b*), the case 22 is formed with guide grooves 23 corresponding to the respective guide ribs 16 of the switch buttons 11. Each guide groove 23 is formed to extend in the lateral direction of the switch button 11. Each guide rib 16 engages a corresponding one of guide grooves 23.

A switch (not shown), which has a movable contact (not shown) formed of an elastic material and a fixed contact on a substrate, is located behind each switch button 11 (on the right-hand side in FIG. 3).

As the elastomer for the supporting member 12 and the hinges 13, polyolefine-based, polyester-based, polyamide-based, polystyrene-based, polyurethane-based materials may be used.

A method of manufacturing the switch button 11 which is constructed as described above will be described with reference to FIGS. 5(*a*) and 5(*b*).

Figure 5A:
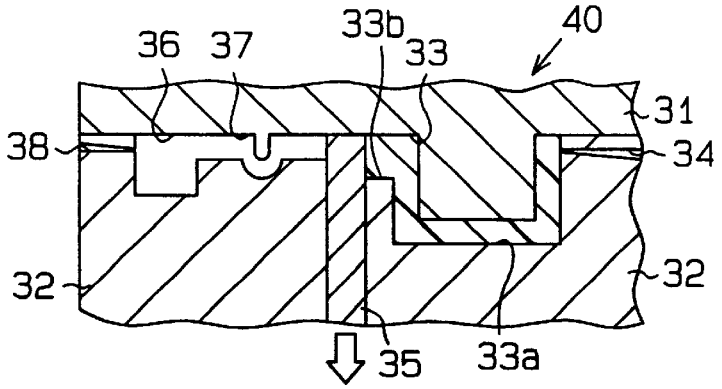
FIG. 5(*a*) is a cross-sectional view showing the state of a mold before the switch button is molded.
Figure 5B:
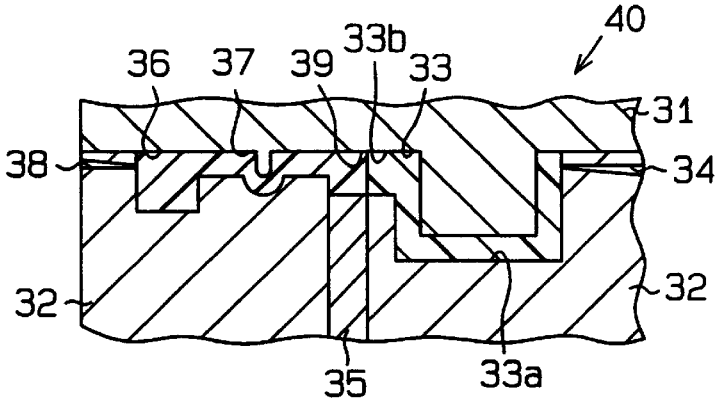

FIGS. 5(*a*) and 5(*b*) are cross-sectional views of a mold for manufacturing the switch button 11 of this embodiment. As illustrated in FIGS. 5(*a*) and 5(*b*), the mold 40 includes a first mold portion 31, a second mold portion 32, and a slide core 35.

FIG. 5(*a*) is a cross-sectional view of the mold 40 for forming the switch button 11. In a state in which the slide core 35 is placed at a mold starting position of FIG. 5(*a*), a first cavity 33 for the switching button 11, a second cavity 36 for the supporting member 12, and a third cavity 37 for the hinge 13 are defined by the first mold portion 31, second mold portion 32, and slide core 35, respectively. The third cavity 37 is connected to the second cavity 36. The first cavity 33 has a shape corresponding to the pressing portion 14 and the second coupling portion 15*b* of each switch button 11 after it is molded. In this embodiment, the first cavity 33 has a fourth cavity 33*a* for the pressing portion 14, and a fifth cavity 33*b* for the second coupling portion 15*b*. For molding the switch button 11, the slide core 35 is first placed at the mold starting position, with the respective cavities being formed, and the first cavity 33 is filled with ABS resin through a first runner 34 arranged in the second mold portion 32.

Next, after the ABS resin has been sufficiently cured, the slide core 35 is moved from the mold starting position shown in FIG. 5(*a*) to a mold ending position shown in FIG. 5(*b*). Then, the second cavity 36, third cavity 37, and sixth cavity 39 for the first coupling portion 15*a* are formed adjacent to the cured ABS resin. The shapes of the second cavity 36, third cavity 37 and sixth cavity 39 correspond to the shapes of the supporting member 12, hinge 13 and first coupling portion 15*a* after the molding. In this state, the respective cavities 36, 37 are filled with an elastomer through a second runner 38 arranged in the second mold portion 32.

Next, after the elastomer has been sufficiently cured, the first and second mold portions 31, 32 are opened to provide a molding as illustrated in FIG. 3. The molding has a switch button 11, hinges 13, and a supporting member 12. The elastomer and the ABS resin are fused to each other at the interface. Therefore, the first coupling portion 15*a* and the second coupling portion 15*b* are integrally coupled, while the switch button 11, hinges 13 and supporting member 12 are integrally molded. Such a molding method is referred to as a two-color molding method (coinjection molding method).

Next, the operation of each switch button 11 will be described.

As illustrated in FIG. 4(*b*), with the switch button 11 mounted in the case 22, as the pressing portion 14 of the switch button 11 is pressed, the switch button 11 is moved along a direction indicated by an arrow in FIG. 4(*b*). Specifically, the guide ribs 16 of the switch button 11 are guided by the guide grooves 23 of the case 22. The switch button 11 is linearly moved parallel to the direction in which the switch button 11 is pressed.

The hinges 13 coupled to the switch button 11 are formed of an elastomer, which is an elastic material having a high flexibility. Therefore, as the switch button 11 is moved along the pressing direction, the curved portion 13*a* of the hinge 13 is extended from the state illustrated in FIG. 4(*a*). As a result, movement of the switch button 11 in the pressing direction is allowed.

On the other hand, when the switch button 11 has been pressed, the switch button 11 returns to the starting position (the position indicated in FIG. 4(*a*)) based on the elasticity of a switch, not shown, located behind the pressing portion 14 of the switch button 11, and the elasticity of the elastomer that forms the hinges 13.

In this way, the switch, not shown, is turned on or off.

This embodiment provides the following advantages.

The hinges are formed of an elastomer material having a high flexibility. Therefore, the switch button 11 can be moved in the pressing direction with a small pressing force, as compared with the conventional structures illustrated in FIGS. 7 and 8. As a result, the operation response is improved.

Since the hinges 13 are formed of elastomer, they readily deform elastically. Therefore, as compared with the conventional structures illustrated in FIGS. 7 and 8, the switch button 11 can be moved parallel to the pressing direction with a light force. This allows a designer to readily set a desired moving direction for the switch button 11.

The hinges 13 and the supporting member 12 are molded using the same elastomer. Therefore, the switch button 11 can be more readily molded as compared with the case where the hinges 13 and the supporting member 12 are molded using different materials.

In the opening 12 of the case 22, only the pressing portion 14 is fitted. Therefore, the boundary of both coupling portions 15*a*, 15*b*, in other words, the boundary of the elastomer and ABS resin is not visible from the outside.

Since the guide ribs 16 of the switch button 11 is guided by the guide grooves 23 of the case 22, the switch button 11 can be readily moved in the pressing direction.

Figure 7:
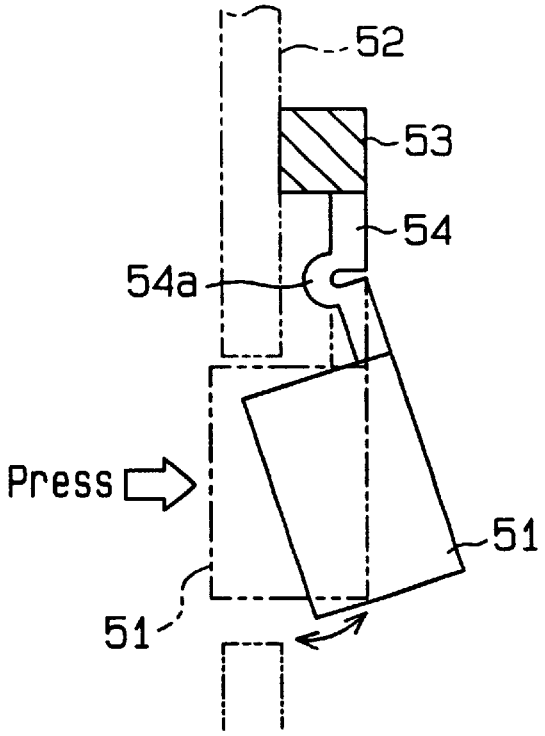
Fig.7 (Prior Art)
FIG. 7 is a side view of a conventional switch button.
Figure 8:
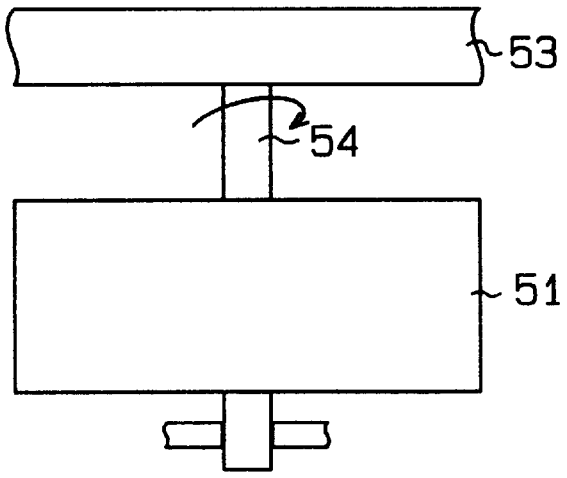
Fig.8 (Prior Art)
FIG. 8 is a front view of another conventional switch button.

The pressing portion 14 of the switch button 11 is formed of ABS resin in a manner similar to the switch buttons 51 illustrated in FIGS. 7 and 8. It is therefore possible to improve only the response of the switch button 11 while maintaining a conventional feel.

The switch button 11, hinges 13 and supporting member 12 formed of ABS resin and an elastomer are molded by the two-color molding method. Therefore, the switch button 11 can be readily molded.

Figure 6:
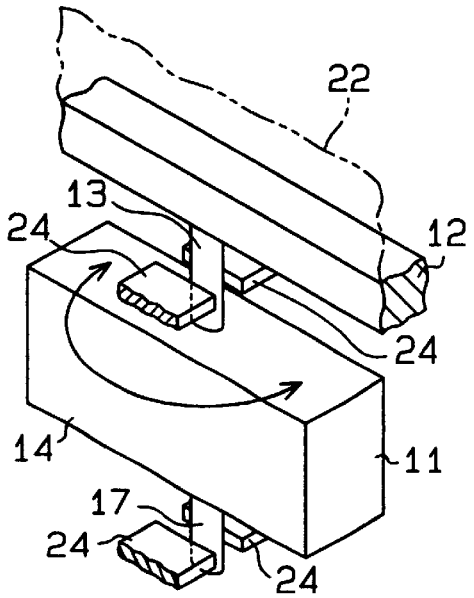
FIG. 6 is a perspective view illustrating a switch button in a second embodiment.

Next, a second embodiment of the present invention will be described with reference to FIG. 6.

In the second embodiment, components that are the same as those in the first embodiment in FIGS. 1 through 5 are given the same reference numerals, and descriptions thereof are omitted.

A switch button 11 is coupled to a supporting member 12 through a cylindrical hinge 13. The supporting member 12 is coupled to a case 22. The hinge 13 is coupled to the top surface of the switch button 11 substantially at the center thereof. The supporting member 12 and the hinge 13 are integrally molded using an elastomer.

The switch button 11 has only a pressing portion 14. A guide portion 17 identical in shape to the hinge 13 is disposed substantially at the center of the bottom surface of the pressing portion 14. The pressing portion 14 and the guide portion 17 are integrally formed using ABS resin.

The case 22 is provided with a plurality (four in FIG. 6) of stopper plates 24 for holding the hinge 13 and the guide portion 17. Two stopper plates 24 stop a corresponding hinge 13 and guide portion 17.

As the switch button 11 is pressed, the hinge 13 is twisted in the pressed direction while in contact with the stopper plate 24. As a result, the switch button 11 pivots about the axis of the hinge 13, and the guide portion 17 also pivots while in contact with the stopper plate 24. Since the hinge 13 is molded using an elastomer material having a high flexibility, the hinge 13 is twisted with a small pressing force. This allows the switch button 11 to readily pivot along a direction indicated by arrows in FIG. 6.

Thus, according to the second embodiment, the following advantages are provided in addition to those of the first embodiment illustrated in FIGS. 1 through 5.

The hinge 13 is formed of an elastomer material having a high flexibility. Therefore, even when the switch button 11 pivots about the axis of the hinge 13, the operation response is improved as in the case where the switch button 11 is linearly moved.

The foregoing embodiments may be modified in the following manner.

In the first embodiment, the coupler 15 may be removed, in which case the hinges 13 formed of an elastomer are directly coupled to the pressing portion 14 formed of ABS resin.

The hinges 13 in the first and second embodiments may only be formed of an elastomer.

The guide rib 16 and the guide groove 23 in the first embodiment may be formed in an arbitrary direction, for example, in an oblique direction. The switch button 51 may be constructed to move in that direction.

The hinges 13 and the supporting member 12 in the respective embodiments may be formed of a synthetic rubber.

The hinges 13 may be linearly formed. In addition, the curved portion 13*a* of the hinge 13 may be in an S-shape.

In the first embodiment, the switch button 11 may be provided with the guide grooves 23, and the case 22 with the guide ribs 16. Also, in place of the guide ribs 16, protruding guide pins may be used.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A switch button assembly comprising:

a switch button;

a support member extending in a longitudinal direction;

a hinge having a first end and a second end, the first end of the hinge integrally formed with the support member, the hinge extending in a direction that is perpendicular to the longitudinal direction of the support member; and a coupler comprising a first coupler portion and a second coupler portion, the first coupler portion formed integrally with the second end of the hinge and the second coupler portion connected to the switch button;

wherein the support member, the hinge and the first coupler portion are formed of an elastomer, and the second coupler portion is formed of a material that is the same as that of the switch button but different than the elastomer used to form the first coupler portion.

2. The switch button assembly of claim 1, wherein the support member, the hinge and the first coupler portion are formed of the same elastomer.

3. The switch button assembly of claim 1, further comprising a guide rib for guiding the switch button to move in a direction that is parallel to a direction in which the switch button is pressed.

4. The switch button assembly of claim 3, wherein the guide rib is integrally molded into the switch button.

5. The switch button assembly of claim 1, wherein the hinge comprises a curved portion.

* * * * *